US010865503B2

(12) United States Patent
Gäbler et al.

(10) Patent No.: US 10,865,503 B2
(45) Date of Patent: Dec. 15, 2020

(54) SAWTOOTH WIRE FOR ROLLERS OF SPINNING PREPARATION MACHINES

(71) Applicant: Truetzschler GmbH & Co. KG., Moenchengladbach (DE)

(72) Inventors: Peter Gäbler, Ebhausen-Rotfelden (DE); Friedrich Haarer, Neubulach (DE)

(73) Assignee: TRUETZSCHLER GMBH & CO. KG, Moenchengladbach (DE)

( * ) Notice: Subject to any disclaimer, the term of this patent is extended or adjusted under 35 U.S.C. 154(b) by 85 days.

(21) Appl. No.: 16/324,076

(22) PCT Filed: Jul. 7, 2017

(86) PCT No.: PCT/EP2017/067085
§ 371 (c)(1),
(2) Date: Feb. 7, 2019

(87) PCT Pub. No.: WO2018/028904
PCT Pub. Date: Feb. 15, 2018

(65) Prior Publication Data

US 2019/0169769 A1 Jun. 6, 2019

(30) Foreign Application Priority Data

Aug. 8, 2016 (DE) ..... 10 2016 114 622

(51) Int. Cl.
*D01G 15/88* (2006.01)

(52) U.S. Cl.
CPC ..... *D01G 15/88* (2013.01)

(58) Field of Classification Search
CPC ..... D01G 15/78; D01G 15/84; D01G 15/86; D01G 15/88; D01G 15/90; D01G 15/92
(Continued)

(56) References Cited

U.S. PATENT DOCUMENTS 2,937,413 A * 5/1960 Hollingsworth ..... D01G 15/88 19/114
3,525,127 A * 8/1970 Hollingsworth ..... D01G 15/88 19/112
(Continued)

FOREIGN PATENT DOCUMENTS

CN 204738066 U 11/2014
DE 8709898 U1 12/1988
WO 99/38661 A1 8/1999

OTHER PUBLICATIONS

International Search Report for PCT/EP2017/067085 dated Oct. 24, 2017.
Written Opinion for PCT/EP2017/067085.

*Primary Examiner* — Shaun R Hurley
*Assistant Examiner* — Bao-Thieu L Nguyen
(74) *Attorney, Agent, or Firm* — FisherBroyles, LLP; Robert Kinberg

(57) ABSTRACT

A sawtooth wire in which each tooth has a tooth tip and a tooth front having a first segment extending from the tooth tip towards a tooth side remote from a bearing edge and towards the tooth back and merging into a concave second segment that merges into a third segment extending towards the tooth side and merging into a concave fourth segment. that merges into a tooth back of the next tooth. The length of a tangent from a turning point of the second segment to the tooth side is greater than or equal to half the spacing between the tooth tip and the tooth side.

15 Claims, 2 Drawing Sheets

(58) Field of Classification Search
USPC ..... 19/114
See application file for complete search history.

(56) References Cited

U.S. PATENT DOCUMENTS

| | | | | | |
|---|---|---|---|---|---|
| 4,268,937 | A * | 5/1981 | Grimshaw | D01G 15/88 | 19/114 |
| 4,653,152 | A * | 3/1987 | Wada | D01G 15/26 | 19/114 |
| 4,937,919 | A * | 7/1990 | Graf | B23D 61/12 | 19/114 |
| 4,953,264 | A * | 9/1990 | Hollingsworth | D01G 15/88 | 19/114 |
| 4,964,195 | A * | 10/1990 | Hollingsworth | D01G 15/88 | 19/114 |
| 5,581,848 | A * | 12/1996 | Egerer | D01G 19/10 | 19/114 |
| 2003/0116006 | A1* | 6/2003 | Graf | D01G 15/88 | 83/835 |
| 2006/0186240 | A1* | 8/2006 | Schuller | D01H 4/32 | 241/294 |
| 2009/0158558 | A1* | 6/2009 | Marz | D01G 15/88 | 19/114 |
| 2009/0293232 | A1* | 12/2009 | Breuer | D01G 15/18 | 19/106 R |
| 2014/0259537 | A1* | 9/2014 | Zhang | B23D 65/02 | 19/114 |
| 2017/0002483 | A1* | 1/2017 | Bocht | D01G 15/14 | |
| 2017/0121863 | A1* | 5/2017 | Gabler | D01G 15/88 | |
| 2017/0137973 | A1* | 5/2017 | Grob | D01G 15/88 | |
| 2018/0135208 | A1* | 5/2018 | Grob | D01G 15/88 | |

* cited by examiner 1
3
2
5
6
10
4

20
21
23
22
α

$h_F$
24
$h_{U1}$
$a_Z$
$l_R$
$h_Z$
14
13
12
11
A

SAWTOOTH WIRE FOR ROLLERS OF SPINNING PREPARATION MACHINES

CROSS-REFERENCE TO RELATED APPLICATIONS

This application is a U.S. National Stage Application of International Patent Application No. PCT/EP2017/067085, filed Jul. 7, 2017, which claims benefit of German Patent Application No. 102016114622.6, filed Aug. 8, 2016.

TECHNICAL FIELD

The invention relates to a sawtooth wire for rolls of spinning room preparation machines, such as carding machines, especially a sawtooth wire for a cylinder.

BACKGROUND OF THE INVENTION

Such sawtooth wires are usually produced in the form of strip material, optionally rolled up on transport reels and, for use, applied in a helical or coil-like manner along an outer periphery of a corresponding roll, for example a cylinder roll. Rolls formed in that way are used for a wide variety of purposes. There are cleaning rolls which are arranged to separate incoming fibre material from impurities, such as, for example, cotton boll material. Other sawtooth wires in turn are arranged to loosen and parallelise fibres, as in the case, for example, of cylinder rolls of carding machines. In the case of rolls positioned intermediately in a processing line it is necessary to take up fibre material from an upstream location and deliver it to a downstream location, and this at the highest possible speed. This is the case, for example, with cylinder rolls, which are provided to take up fibre material from a licker-in roll and deliver it to a doffer roll. It has been found in the case of the known sawtooth wires that too much fibre material passes in the direction of the roll and is therefore not delivered to the downstream location or is delivered only in an inadequate amount. A lowest region between two teeth, usually the transition region between the tooth front of one tooth and the tooth back of the next tooth (referred to as the inter-tooth pace hereinbelow) in the row of teeth of the sawtooth wire, has, seen transversely with respect to the longitudinal extent of the sawtooth wire, when stretched out, a spacing from a bearing surface of the sawtooth wire on the roll that is sufficiently small to be able to bend the sawtooth wire in order that the latter can be laid around the associated roll, as described above, and thus applied to that roll. During operation, fibres have a tendency to accumulate in that transition region and therefore have the effect that fibre material that is usable per se does not pass to further processing, that is to say, for example, is not taken up by a doffing roll.

SUMMARY OF THE INVENTION

The object of the invention is to at least reduce that disadvantage.

That object is achieved by the subject matter disclosed herein and recited in the accompanying claims.

According to the invention there is provided a sawtooth wire which is adapted to be applied in a helical or coil-like manner to a roll of a spinning room preparation machine along an outer periphery of the roll and substantially transversely with respect to the rotational axis thereof. The sawtooth wire is in known manner preferably produced in the form of strip material, for example rolled onto a transport reel and, on application to a roll, applied in a helical or coil-like manner to the outer periphery thereof. The sawtooth wire has a tooth base having a bearing edge which extends along the longitudinal extent of the sawtooth wire. That bearing edge serves as the future bearing portion or contact portion with the roll to which the sawtooth wire is to be applied. Furthermore, the sawtooth wire has a row of teeth which is formed on a tooth side of the tooth base remote from and opposite to the bearing edge. If the sawtooth wire is stretched out, that is to say is neither rolled up onto a transport reel nor applied to a roll, it ideally runs along a straight line. In that state the row of teeth extends along the longitudinal extent of the sawtooth wire and comprises individual teeth. The teeth are arranged one after the other in a row along the longitudinal extent of the sawtooth wire in such a way that they project from the tooth side substantially perpendicularly to the longitudinal extent of the sawtooth wire. Each tooth has a tooth tip which points along the longitudinal extent of the sawtooth wire and in the same direction as the tooth tips of the other teeth of the row of teeth. That direction can lie parallel to the tooth side or enclose an acute angle therewith, that is to say point away from the tooth side. Furthermore, each tooth has a tooth front. Starting from the associated tooth tip of the respective tooth, the tooth front is formed in such a way that in a first segment it extends at an acute angle with respect to the tooth side towards an associated tooth back of the tooth. The first segment merges into a concave second segment which adjoins the end of the first segment remote from the tooth tip. The end of the second segment remote from the first segment points at an acute angle with respect to the tooth side in the direction of the tooth side and away from the associated tooth back. The second segment in turn merges into a third segment which adjoins the end of the second segment remote from the first segment, which third segment extends further towards the tooth side and likewise away from the associated tooth back. The third segment merges into a concave fourth segment which adjoins the end of the third segment remote from the second segment, the end of which fourth segment remote from the third segment points along the longitudinal extent of the sawtooth wire and away from the associated tooth back. The fourth segment then merges into a tooth back of the subsequent tooth in the row of teeth, which tooth back adjoins the end of the fourth segment remote from the third segment, and therefore borders upon that tooth back. Furthermore, in the afore-mentioned second segment there is a turning point at which a second tangent applied to the second segment runs perpendicularly to the tooth side. The length of the tangent from the turning point to the tooth side is greater than or equal to half the spacing, seen along the tangent (transversely with respect to the longitudinal extent of the sawtooth wire), between the associated tooth tip and the tooth side. The length of the tangent therefore defines the spacing between the turning point and the tooth side. This results in a tooth tip that is relatively low in relation to the height dimension of the entire tooth. This has the result that in the applied state of the sawtooth wire, that is to say when the latter has been applied to an associated roll, fibre material which is to be processed (for example carded) by means of the teeth is no longer able to pass so easily into the inter-tooth spaces and remain therein. In particular, the circumstance that the fourth, concave segment merges directly into the tooth back of the next tooth means that this transition point is very small. This has the effect that it is scarcely possible for fibres to collect therein but instead, on account of the rotational speed of the associated roll, they are guided as it were immediately in the direction of the second segment which has a rather high position in relation to the surface of the roll. As a result, more fibre material is supplied to further processing (for example in the form of a drawing operation) than in the case of conventional sawtooth wires. There is a reduction in waste and, in association therewith, also in rejected material; the efficiency of a spinning room preparation machine equipped with such a sawtooth wire is improved. As a result, the fibres are guided in a higher position in relation to the surface of the roll.

Preferably the ratio between the length of the second tangent, that is to say the spacing of the turning point from the tooth side, and the afore-mentioned spacing between the tooth tip and the tooth side is 4:5. As a result, more fibre material passes into the afore-mentioned third segment and from there can be conveyed in the direction of the second segment close to the associated tooth tip when the respective tooth, with the tooth tip to the front, is guided past fibre material.

In the afore-mentioned cases the second segment can correspond to a portion of a perimeter of an ellipse. As a result, a tooth front that is free of sharp edges and therefore runs continuously is formed in this region. The risk of fibres becoming stuck in this region of the tooth front is averted or at least greatly reduced.

Preferably the ellipse is a circle having a predetermined radius. This is a geometric shape that is especially simple to produce.

The radius is preferably smaller than a difference between the length of the second tangent and the afore-mentioned spacing between the tooth tip and the tooth side. This enables the turning point to be positioned very close to the associated tooth tip, which helps further to reduce the waste.

The radius is in both cases preferably approximately 0.07 mm. This has proved to be a very advantageous value in respect of fibre uptake at the tooth front. In the context of the invention the term "approximately" refers to production-related tolerances in relation to the parameter in question, in this case the radius.

In the case of all sawtooth wires indicated above, the afore-mentioned spacing between the tooth tip and the tooth side is preferably approximately 0.5 mm. This is an especially suitable value in order to be able to process fibres sufficiently.

In the case of the variants indicated above, the ratio between the tip height, that is to say the spacing between the tooth side and the tooth tip in a direction transverse with respect to the tooth side, i.e. with respect to the longitudinal extent of the sawtooth wire, and a tooth spacing along the longitudinal extent of the sawtooth wire from the tooth tip of a tooth to the tooth tip of the immediately adjacent tooth of the row of teeth, can be 5:17. This results in an operationally very advantageous ratio between the tooth height (height without the tooth base) and the spacing between two immediately adjacent sawtooth wire teeth.

Such a tooth spacing, with or without maintenance of the ratio of 5:17, can be less than approximately 2 mm, preferably approximately 1.7 mm or 1.5 mm. Those lengths have proved to be especially advantageous in respect of the fibres to be processed, especially in respect of their length.

In the case of all the afore-mentioned sawtooth wires, the second tangent and a first tangent applied to the first segment at the location of the associated tooth tip preferably enclose a predetermined acute angle.

That angle is preferably substantially at least 30° and at most 55°. That angle range allows very efficient fibre treatment.

In the case of each of the afore-mentioned sawtooth wires, the tooth back of a tooth preferably comprises a fifth and a sixth segment. The fifth segment adjoins the fourth segment of the respective preceding tooth of the row of teeth and extends away from that fourth segment. The sixth segment in turn then adjoins the fifth segment at the end thereof remote from the fourth segment and extends towards the tooth tip of the associated tooth. Finally, the fifth and the sixth segments enclose with the tooth side acute angles that are of different largest sizes to one another. That is to say, the two segments slope upwards in the direction of the tooth tip at different gradients to one another in relation to the tooth side and thus make possible a kind of intermediate uptake of fibres, but at least guidance of fibres in the direction of the second segment of the respective tooth front immediately abutting the tooth back in the row of teeth.

The largest angle between the fifth segment and the tooth side is preferably smaller than the largest angle between the sixth segment and the tooth side. The received fibres accordingly pass over the sixth segment considerably more slowly, or not at all, in the direction of the tooth side than is allowed by the fifth segment. Fibres can thus be better conveyed into the processing process, for example by centrifugal force, than would be possible with a segment having only one gradient.

In addition or alternatively, the tooth back can further comprise a seventh segment which adjoins the sixth segment at the end thereof remote from the fifth segment. The seventh segment encloses with the tooth side a largest acute angle that is larger than the largest angle between the sixth segment and the tooth side. Accordingly, a kind of step is formed in the region of the sixth segment, although it does not necessarily run parallel to the tooth side and therefore as it were horizontally. The tooth tip of the associated tooth therefore projects further from the tooth side than does the sixth segment and can accordingly be optimised for extracting fibres, while the seventh segment and the second segment of the respective tooth front bordering upon the sixth segment can be optimised for conducting and discharging undesired fibres.

Preferably the tooth back additionally comprises an eighth segment which adjoins the seventh segment at the end thereof remote from the sixth segment. This eighth segment encloses with the tooth side a largest acute angle that is smaller than the largest angle between the seventh segment and the tooth side. This results in the formation of a kind of hump between the tooth tip and the seventh segment, which hump has an action similar to that of the sixth segment in respect of the fibres.

In the case of each of the afore-mentioned sawtooth wires, the transition region between at least two segments that are immediately adjacent to one another and/or the transition region between the respective fourth segment and the adjoining tooth back can be continuous. That is to say, in an extreme case, between two tooth tips that are arranged immediately adjacent to one another there are no discontinuous transitions that could allow or promote adhesion of fibres and accordingly have an adverse effect on the action of the sawtooth wire.

BRIEF DESCRIPTION OF THE DRAWINGS

Further features and advantages of the invention will be apparent from the following description of preferred embodiments. In the drawings.

DETAILED DESCRIPTION OF THE INVENTION

Figures 1A, 1B, 1C:
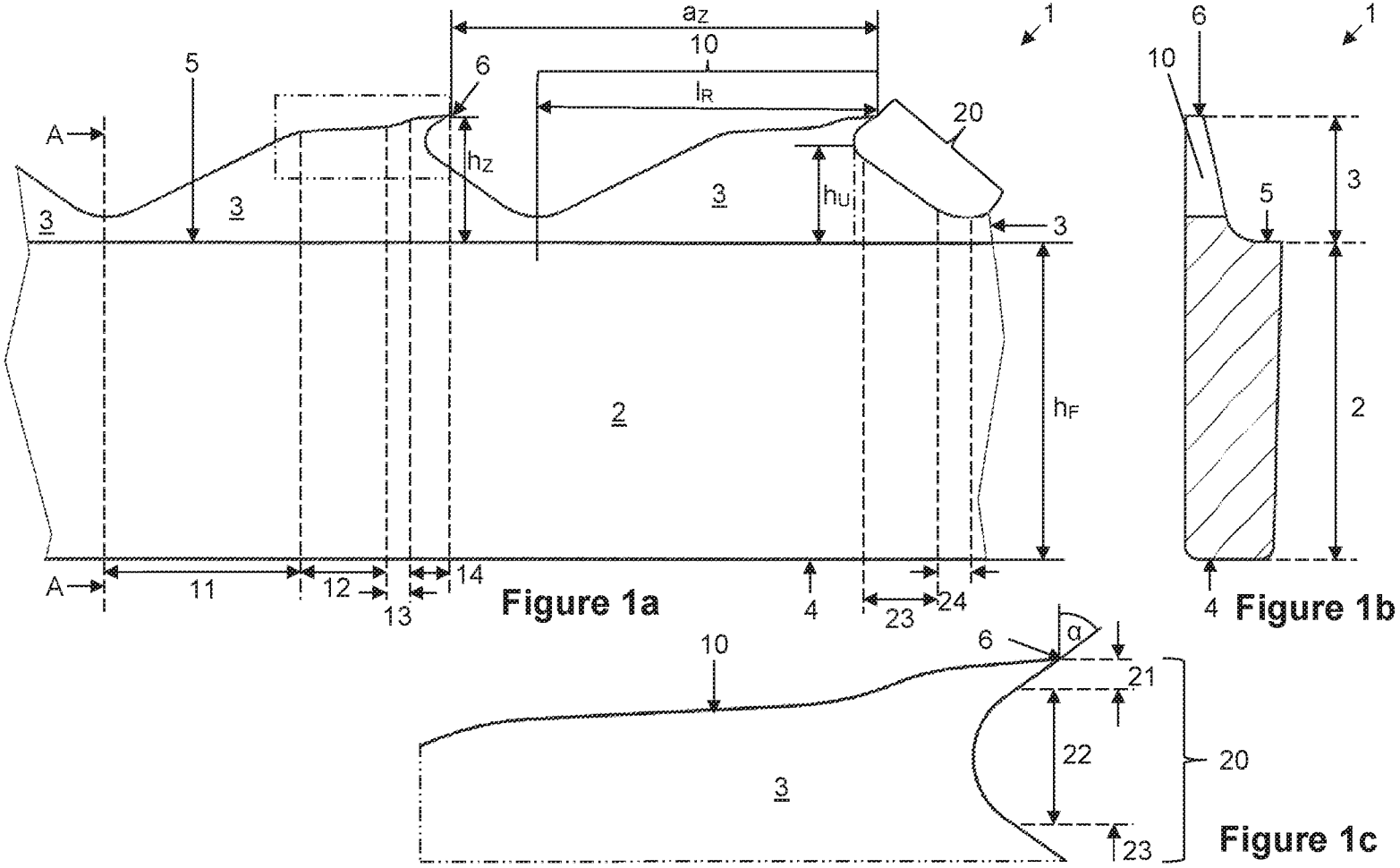
FIGS. 1*a* to 1*c* show various views of a sawtooth wire according to a first embodiment of the invention.

FIG. 1*a* shows a side view of a sawtooth wire 1 according to a first embodiment of the invention when the sawtooth wire 1 is stretched out. FIG. 1*b* shows the sawtooth wire 1 in section along a line A-A in FIG. 1*a*. FIG. 1*c* in turn is a detail view on an enlarged scale of the region delineated by a rectangle in FIG. 1*a*.

The sawtooth wire 1 has in a lower region in FIG. 1*a* and FIG. 1*b* a tooth base 2, on the upper side of which a row of teeth is formed. The row of teeth consists essentially of a plurality of teeth 3 arranged in a row one after the other.

The tooth base 2 has an underside which serves as a bearing edge 4 for the roll (not shown) to which the sawtooth wire 1 is to be applied. The side of the tooth base 2 facing towards the teeth 3 forms a tooth side 5. As can be seen in FIG. 1*b*, the tooth side 5 is formed in such a way that, starting from the right-hand edge of the tooth base 2, in the direction of the tooth 3 it merges into the latter.

The teeth 3 have in known manner a tooth back 10 and a tooth front 20 which at one end meet at a tooth tip 6 of the respective tooth 3 and at the other end merge into the tooth front 20 of the immediately preceding tooth 3 and the tooth back 10 of the immediately following tooth 3, respectively.

The tooth base 2 is formed from a material which allows the sawtooth wire 1 to be applied to an associated roll. For that purpose it has a predetermined height $h_F$.

The tooth back 10 of the respective tooth 3 begins, starting from the tooth front 20 of the preceding tooth 3, that is to say on the left in FIG. 1*a*, with a segment 11 which slopes upwards in relation to the tooth side 5 in the direction of the tooth tip 6. The segment 11 runs at an acute angle with respect to the tooth side 5 towards the tooth tip 6. This segment 11 is adjoined by a segment 12 of the tooth back 10. The segment 12 has a relatively shallow gradient in relation to the tooth side 5 or is even parallel thereto. At its end remote from the segment 11, in this case the right-hand end, the segment 12 merges into a next segment 13 which has a steeper gradient than the segment 12 and, by way of example, a shallower gradient than the segment 11. The segment 13, at its end remote from the segment 12, in turn leads into what is then the last segment 14 of the tooth back 10. The end of the segment 14 remote from the segment 13, in conjunction with an adjoining segment 21 of the tooth front 20, forms the tooth tip 6.

Starting from the tooth tip 6, the segment 21 extends away from the tooth tip 6 towards the tooth side 5 and towards the tooth back 10 of the same tooth 3. The segment 21, which runs substantially in a straight line, merges at its end remote from the tooth tip 6 into a segment 22 which in the example shown follows the perimeter of a circle having a predetermined radius. The radius is by way of example approximately 0.07 mm. The transition between the segments 21 and 22 is preferably continuous. This has the advantage that fibres located therein are able to move past the tooth front 20 without the risk of becoming stuck.

At a lower end remote from the segment 21 the segment 22 merges into a subsequent segment 23. In the example shown, the latter segment is preferably formed as a straight segment similar to segment 21. It extends towards the tooth side 5 and towards the tooth back 10 of the subsequent tooth 3. This accordingly results in a region that slopes downwards in relation to the tooth base 2. At its end remote from the segment 22 the segment 23 merges into a concave segment 24 which, at its end remote from the segment 23, borders upon the tooth back 10 of the immediately subsequent tooth 3. The segment 24 has a minimum spacing from the tooth side 5 in relation to the rest of the tooth 3, which spacing is sufficient for laying the sawtooth wire 1 around a roll. For that purpose it is necessary to deform the sawtooth wire 1 so that the bearing edge 4, which runs in a straight line in FIG. 1, rests tightly against the outer periphery of the roll in all places. That minimum spacing is preferably 0.1 mm.

At its point furthest to the left in FIG. 1 the segment 22 has a spacing or a height $h_U$ perpendicular to the tooth side 5 that is by way of example 0.5 mm. That point is therefore substantially higher, in relation to the tooth side 5, than half the spacing, or height $h_Z$, of the tooth tip 6 from the tooth side 5. That spacing accordingly corresponds to the length of a tangent (perpendicular dot-dashed line) which can be applied at that location and runs perpendicularly to the tooth side 5.

In the example shown, a tooth tip spacing $a_Z$ between the tooth tips 6 of two immediately successive teeth, that is to say the pitch, is less than approximately 2 mm, preferably approximately 1.7 mm or 1.5 mm with a tolerance of +0.06 mm to −0.03 mm.

A length $I_R$ of the respective tooth back 10 along the longitudinal extent of the sawtooth wire 1, when stretched out, that is to say along the tooth side 5, is by way of example more than half the afore-mentioned tooth tip spacing $a_Z$.

A tangent applied to the segment 21 in the region of the tooth tip 6 encloses a predetermined angle $\alpha$ with a line that is perpendicular to the tooth side 5 and intersects the tooth tip 6. In the example shown, the angle $\alpha$ is 55° and is accordingly exactly the same size as a corresponding angle between that tangent and the afore-mentioned tangent applied to the turning point in segment 22.

The tooth base 2 in FIG. 1*b* can of course also point towards the left, so that the sawtooth wire 1 in this illustration is reflected along a vertical line.

Figure 2:
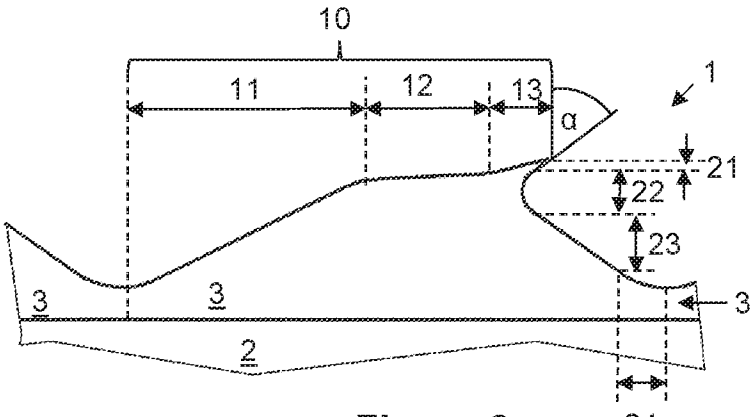
FIG. 2 shows a sawtooth wire according to a second embodiment of the invention.

FIG. 2 shows a sawtooth wire 1 according to a second embodiment of the invention. As can be seen, instead of four segments the tooth back 10 here has only three segments 11-13. The segments 11-13 are formed similarly to the segments 11-13 of the first embodiment; segment 14 is absent. This has the result that a tangent applied to the segment 13 and intersecting the tooth tip 6 encloses with the tooth side 5 a larger acute angle $\alpha$ than in the case of the first embodiment of the invention. The angle $\alpha$ is by way of example identical dimensioned to the first embodiment.

Figure 3:
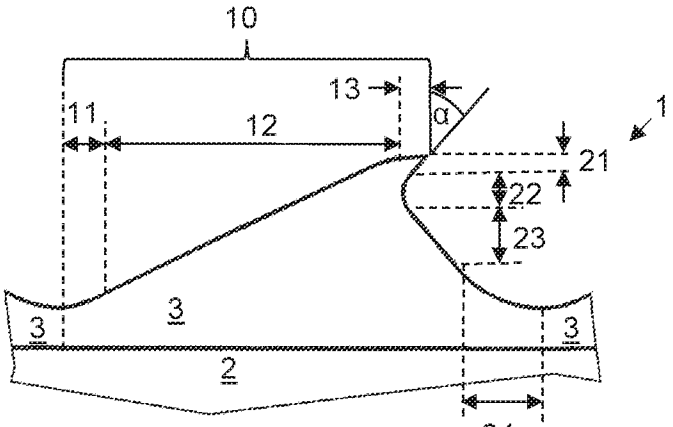
FIG. 3 shows a sawtooth wire according to a third embodiment of the invention.

FIG. 3 shows a sawtooth wire 1 according to a third embodiment of the invention. In this case there are again likewise only three segments 11-13 for the tooth back 10. The segment 11 is a concave segment which, at its end remote from the previous tooth 3, merges into a segment 12 which is formed by means of a plane that slopes upwards in relation to the tooth side 5. The adjoining segment 13, which extends towards the tooth tip 6 (without a reference sign in this Figure), is preferably formed in the same way as the segment 14 of the first embodiment of the invention. That is to say, in this case the segment 12 present in the first embodiment is absent. Furthermore, the segment 21 has a steeper gradient than in the case of the second embodiment. As a result, the angle α is comparatively smaller and is 40° in the example shown.

Figure 4:
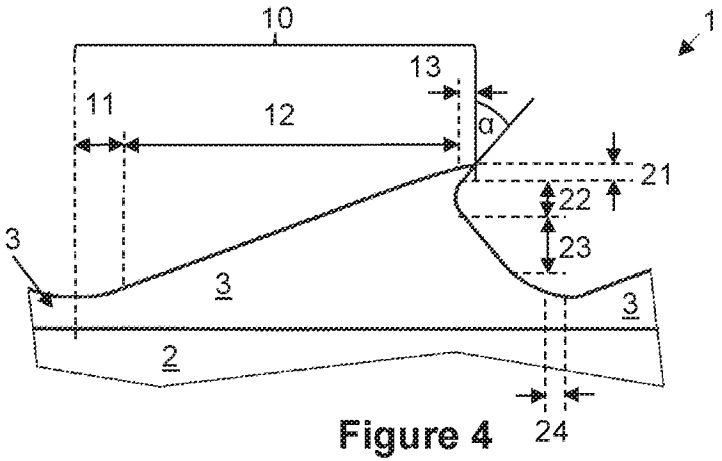

FIG. 4 shows a sawtooth wire 1 according to a fourth embodiment of the invention. In contrast to the third embodiment, the segment 13 is relatively short.

Figure 5:
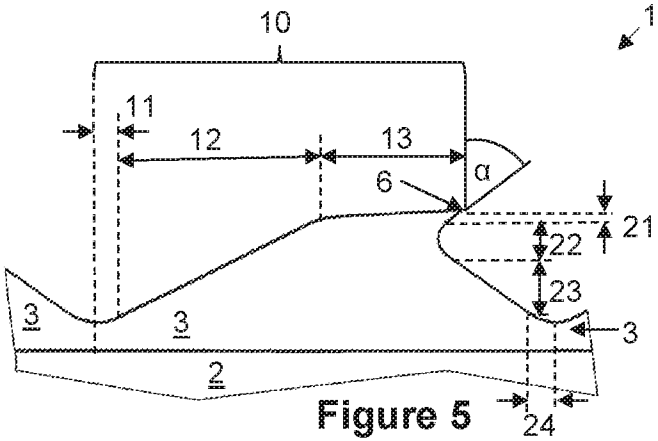
FIG. 4 shows a sawtooth wire according to a fourth embodiment of the invention and FIG. 5 shows a sawtooth wire according to a fifth embodiment of the invention.

FIG. 5 shows a sawtooth wire 1 according to a fifth embodiment of the invention.

In this case the segment 13 is substantially longer than in the case of the previous embodiments. This has the result that the respective fibres spend a longer time in the upper region of the sawtooth wire 1 and accordingly reduces the risk of fibres being able to accumulate in the region of the segment 11.

In addition, the segment 24 is shorter than in the case of the preceding embodiments.

The invention is not limited to the embodiments described above.

Preferably, apart from the pairs of segments 13, 21 and 14, 21 forming the tooth tip 6, the segments 11-14, 21-24 in parts or as a whole merge continuously into one another so that in the relevant regions there are no discontinuous transitions that could promote or allow sticking or adhesion of fibres.

The above-described shapes of the tooth front 20 and tooth back 10, or of their segments 11-14; 21-24, can be combined with one another or interchanged with one another in any desired way.

For example, the second and the fifth embodiments can be combined with one another in such a way that the tooth backs 10 have a terrace-like form.

The afore-mentioned radius in the case of segment 22 can also assume a different value.

Segment 22 can also correspond to part of a perimeter of a non-circular ellipse.

As a result, the invention provides a sawtooth wire 1 which is suitable especially for cylinders and effectively prevents fibres from being able to accumulate in the lower region, that is to say in the region between the tooth front 20 and the tooth back 10 of two immediately successive teeth 3. That is to say, the bulk of the fibres are kept substantially further away from the tooth side 5 and closer to the respective tooth tip 6. This has the particularly advantageous effect that the fibres can be taken up from the sawtooth wire 1 by a complementary roll. Particularly in the case of carding, the fibres can thus be better supplied to the doffing roll, which improves the efficiency of the spinning room preparation machine provided with the sawtooth wire 1. A further advantage is that, by virtue of the sawtooth wire according to the invention, the fibres can be better supplied to other elements interacting with the sawtooth wire, such as flats and bars.

The invention claimed is:

1. A sawtooth wire adapted to be applied in a coil-like manner to a spinning room preparation machine roll along an outer periphery of the spinning room preparation machine roll and approximately transversely with respect to a rotational axis of the spinning room preparation machine roll, comprising:

a tooth base having a bearing edge, which extends along a longitudinal extent of the sawtooth wire, the tooth base having a tooth side remote from and opposite to the bearing edge; and a row of teeth located on the tooth side of the tooth base, wherein when the sawtooth wire is stretched out:

the row of teeth extends along the longitudinal extent of the sawtooth wire;

teeth of the row of teeth are arranged one after another in a row along the longitudinal extent of the sawtooth wire so that they project from the tooth side perpendicularly to the longitudinal extent of the sawtooth wire; and each tooth includes:

a tooth tip which points along the longitudinal extent of the sawtooth wire in a same direction as the tooth tips of the other teeth of the row of teeth and lies parallel to the tooth side or encloses an acute angle with the tooth side;

a tooth back behind the tooth tip; and a tooth front including first, second, third and fourth segments, wherein starting from the tooth tip of the tooth:

the first segment extends at an acute angle towards the tooth side and towards the associated tooth back of the tooth, and merges into the second segment;

the second segment is concave and adjoins an end of the first segment remote from the tooth tip, wherein an end of the second segment remote from the first segment points at an acute angle with respect to the tooth side towards the tooth side and away from the associated tooth back, and merges into the third segment;

the third segment adjoins the end of the second segment remote from the first segment, wherein the third segment extends towards the tooth side and away from the associated tooth back and merges into the fourth segment; and the fourth segment is concave and adjoins an end of the third segment remote from the second segment, wherein an end of the fourth segment remote from the third segment points in the direction of the longitudinal extent of the sawtooth wire and away from the associated tooth back, and wherein the end of the fourth segment remote from the third segment borders upon the tooth back of the subsequent tooth in the row of teeth;

wherein the second segment has a turning point at which a tangent applied to the second segment runs perpendicularly to the tooth side, a length of the tangent from the turning point to the tooth side is greater than or equal to half of a spacing between the associated tooth tip and the tooth side, and a ratio between the length of the tangent and the spacing is 4:5.

2. The sawtooth wire according to claim 1, wherein the second segment corresponds to a part of a perimeter of an ellipse.

3. The sawtooth wire according to claim 2, wherein the ellipse is a circle having a predetermined radius.

4. The sawtooth wire according to claim 2, wherein the radius is smaller than a difference between the length of the tangent and the spacing.

5. The sawtooth wire according to claim 2, wherein the radius is substantially 0.07 mm.

6. The sawtooth wire according claim 1, wherein the spacing is substantially 0.5 mm.

7. The sawtooth wire according to claim 1, wherein a ratio between the spacing and a tooth tip spacing along the longitudinal extent of the sawtooth wire from the tooth tip of a tooth of the row of teeth to the tooth tip of an immediately adjacent tooth of the row of teeth is substantially 5:17.

8. The sawtooth wire according to claim 1, wherein a tooth tip spacing along the longitudinal extent of the sawtooth wire from the tooth tip of a tooth of the row of teeth to the tooth tip of an immediately adjacent tooth of the row of teeth is less than approximately 2 mm.

9. The sawtooth wire according to claim 1, wherein the tangent and a further tangent applied to the first segment at a location of the associated tooth tip enclose a predetermined acute angle.

10. The sawtooth wire according to claim 9, wherein the predetermined angle approximately is 30°;

lies between 30° and 55°; or is 55°.

11. The sawtooth wire according to claim 1, wherein the tooth back of a respective one of the teeth comprises:

a fifth segment which adjoins the fourth segment of the respective preceding tooth of the row of teeth and extends away from that fourth segment; and a sixth segment which adjoins the fifth segment at the end thereof remote from the fourth segment and extends towards the tooth tip of the tooth;

wherein the fifth and the sixth segments enclose with the tooth side acute angles that are of different sizes to one another.

12. The sawtooth wire according to claim 11, wherein the angle between the fifth segment and the tooth side is larger than the angle between the sixth segment and the tooth side.

13. The sawtooth wire according to claim 12, wherein the tooth back of the tooth further comprises a seventh segment which adjoins the sixth segment at an end thereof remote from the fifth segment, and the seventh segment encloses with the tooth side an acute angle that is larger than the angle between the sixth segment and the tooth side.

14. The sawtooth wire according to claim 13, wherein the tooth back further comprises an eighth segment which adjoins the seventh segment at an end thereof remote from the sixth segment; and the eighth segment encloses with the tooth side an acute angle that is smaller than the angle between the seventh segment and the tooth side.

15. The sawtooth wire according to claim 14, wherein a transition region between at least two of the segments that are immediately adjacent to one another and/or between the respective fourth segment and the adjoining tooth back is or are continuous.

* * * * *